US009135765B2

(12) United States Patent
Sackfield et al.

(10) Patent No.: US 9,135,765 B2
(45) Date of Patent: Sep. 15, 2015

(54) COIN VALIDATION APPARATUS

(71) Applicant: Innovative Technology Limited, Oldham (GB)

(72) Inventors: Martin Sackfield, Oldham (GB); Matthew Strong, Oldham (GB); John Robinson, Oldham (GB)

(73) Assignee: Innovative Technology Ltd., Oldham (GB)

( * ) Notice: Subject to any disclaimer, the term of this patent is extended or adjusted under 35 U.S.C. 154(b) by 0 days.

(21) Appl. No.: 14/226,352

(22) Filed: Mar. 26, 2014

(65) Prior Publication Data

US 2014/0299442 A1 Oct. 9, 2014

(30) Foreign Application Priority Data

Apr. 8, 2013 (GB) ..... 1306244.3

(51) Int. Cl.
*G07D 5/08* (2006.01)
*G07D 5/00* (2006.01)
*G07D 3/14* (2006.01)

(52) U.S. Cl.
CPC .. *G07D 5/08* (2013.01); *G07D 5/00* (2013.01); *G07D 3/14* (2013.01)

(58) Field of Classification Search
CPC ..... G07D 5/08; G07D 3/14
USPC ..... 194/318, 323, 344
See application file for complete search history.

(56) References Cited

U.S. PATENT DOCUMENTS

| | | | | |
|---|---|---|---|---|
| 2,540,063 | A * | 1/1951 | Victoreen | 194/318 |
| 3,994,309 | A | 11/1976 | Marklew | |
| 4,512,454 | A * | 4/1985 | Schuller et al. | 194/346 |
| 4,998,610 | A * | 3/1991 | Said et al. | 194/318 |
| 5,062,518 | A * | 11/1991 | Chitty et al. | 194/317 |
| 7,625,272 | B1 * | 12/2009 | Moreland et al. | 453/3 |
| 7,661,521 | B2 * | 2/2010 | Abe et al. | 194/344 |
| 2004/0180619 | A1 * | 9/2004 | Picollo | 453/7 |
| 2009/0166151 | A1 * | 7/2009 | Martin et al. | 194/317 |

* cited by examiner

*Primary Examiner* — Mark Beauchaine
(74) *Attorney, Agent, or Firm* — McKee, Voorhees & Sease, PLC

(57) ABSTRACT

A coin validator apparatus includes an inclined coin chute interconnecting the coin outlet gate with a coin rejection outlet via a validation sensor module and a coin diverter mechanism, the coin chute defining a coin transport path and including a radially outer curved guide wall, such that in operation a coin exiting the coin outlet gate and traversing the coin transport path is subjected to a centripetal acceleration that constrains the coin to follow and abut the contour of the radially outer curved guide wall between the coin outlet gate and a coin diverter sensor disposed downstream in the coin transport path.

23 Claims, 7 Drawing Sheets

COIN VALIDATION APPARATUS

CROSS-REFERENCE TO RELATED APPLICATIONS

This Application claims priority to United Kingdom patent application GB 1306244.3 filed on Apr. 8, 2013, the entire contents of which are herein incorporated by reference.

FIELD OF THE INVENTION

The present invention relates to improvements in coin separation and identification. In particular, the present invention relates to a coin validator for individualising and verifying the authenticity of coins.

BACKGROUND OF THE INVENTION

The term 'coin' is used to mean any discoid body such as, but not limited to, monetary coins, tokens, medals and other such similar items.

Conventional approaches to coin validation are varied and numerous. For example, EP-A-2,242,029 describes a coin singulating and testing device comprising a collection box casing enclosing an inclined motorised rotor. The rotor includes a plurality of coin receptacles for receiving and transporting coins in a circular manner passed a sensor device for determining if the coins are genuine.

The device disclosed in EP-A-2,242,029 includes a flap in the floor of the circular coin path that can be selectively opened and closed. When a coin is determined to be genuine, the flap is held open such that the coin falls under gravity into a delivery opening.

With other conventional coin validation devices a coin typically traverses a pathway through a sensor region by rolling edgewise down an inclined sensing track. A problem arises with this approach in that the coin is unstable and will wobble leading to undesirable coin-to-coin variations in the electromagnetic coupling between the sensing coils and the coin under test. Coin wobble can be reduced by narrowing the sensor region passageway, but this increases the likelihood of coins becoming jammed, especially if the throughput of coins is erratic or irregular.

For reliable coin validation various properties of a coin need to be detected. Typically, this is achieved using discrete frequency analysis, but this leads to an increase in the number of sensor coils required, and the speed of operation imposes a limit on the rate at which coins can be validated.

The present invention seeks to address the problems associated with prior art devices.

SUMMARY OF THE INVENTION

According to an aspect of the present invention there is provided a coin validator comprising: a motor-driven coin rotor mechanism including at least one coin receptacle, wherein the coin rotor mechanism is adapted to transport a coin received in said at least one coin receptacle to a coin outlet gate disposed at a peripheral edge of said coin rotor mechanism; characterised by: an inclined coin chute interconnecting the coin outlet gate with a coin rejection outlet via a validation sensor module and a coin diverter mechanism, the coin chute defining a coin transport path and including a radially outer curved guide wall, such that in operation a coin exiting the coin outlet gate and traversing the coin transport path is subjected to a centripetal acceleration that constrains the coin to follow and abut the contour of the radially outer curved guide wall downstream from the coin outlet in the coin transport path.

Advantageously, in operation a circumferential edge of the coin abuts and follows the contour of the radially outer curved guide wall, thus ensuring that the coin is following a fixed and stable path between the coin outlet gate and a coin diverter sensor disposed downstream in the coin transport path.

The coin diverter mechanism comprises an opening in the coin chute and an associated gate that is moveable between an open and a closed position. The gate is held in an open position during normal operation to provide coin access to a coin storage and dispensing hopper. However, a controller-operated solenoid closes the gate when an unacceptable coin is detected by the validation sensor module.

Preferably, the opening is disposed within the floor of the coin chute, and the floor is substantially orthogonal to the outer curved guide wall.

Preferably, the diverter mechanism is positioned downstream from said coin diverter sensor, and the coin diverter sensor comprises a light transmitter element adjacent to a corresponding light receiver element, both the light transmitter element and the light receiver element being disposed opposite a light-return arrangement.

An optional coin rejection sensor is positioned downstream from said coin diverter mechanism; the coin rejection sensor provides confirmation of coin ejection and comprises a light transmitter element adjacent to a corresponding light receiver element, both the light transmitter element and the light receiver element being disposed opposite a light-return arrangement.

Preferably, the coin transport path defined by the coin chute between the coin diverter mechanism and the coin rejection sensor includes a radially outer curved guide wall, and the coin chute describes a substantially S-shaped coin path between the validation sensor module and the coin rejection sensor.

The validation sensor module comprises: an elongate transmission coil and an opposing elongate receiver coil; a first circular transmission coil and an opposing first circular receiver coil; a second circular transmission coil and an opposing second circular receiver coil; and an acoustic sensor disposed proximal to a coin percussion element.

Preferably, the elongate transmission coil is energised by a signal at a frequency between 500 kHz and 1 MHz, and the first and second circular transmission coils are energised by a signal at frequencies between 2 kHz and 50 kHz that is a linear superposition of a plurality of sinusoidal waves. It is also preferable that the acoustic sensor is a microphone.

The coin validator includes a processor adapted to send and receive transmission coil signals, receive receiver coil signals and acoustic sensor signals, and to perform Fast Fourier Transform analysis on said signals.

According to a further aspect of the present invention there is provided a method of validating a coin comprising: introducing at least one coin to a motor-driven coin rotor mechanism including at least one coin receptacle; receiving the at least one coin in the at least one receptacle; transporting the at least one coin via the rotor mechanism to a coin outlet gate disposed at a peripheral edge of said coin rotor mechanism; characterised by: providing an inclined coin chute interconnecting the coin outlet gate with a coin rejection outlet via a validation sensor module and a coin diverter mechanism, wherein the coin chute defines a coin transport path and includes a radially outer curved guide wall; ejecting the at least one coin from the coin outlet gate so as to be subjected to a centripetal acceleration that constrains the coin to follow and abut the contour of the radially outer curved guide wall downstream from the coin outlet gate in the coin transport path.

Preferably, the method further comprises: energising an elongate transmission coil with a first signal; energising a first circular transmission coil with a second signal; energising a second circular transmission coil with the second signal; in response to the at least one coin passing through the validation sensor module receiving at a processor: an elongate receiver coil signal, a first circular receiver coil signal, a second circular receiver coil signal, an acoustic sensor signal, and the second signal; and said processor performing a Fast Fourier Transform analysis on each of the received signals to determine amplitude and phase differences between the received signals and the second signal.

The second signal is a linear superposition of a plurality of sinusoidal waves with frequencies between 2 kHz and 50 kHz, and the first signal is at a frequency between 500 kHz and 1 MHz.

The second signal can be expressed as: $\Sigma_n$ ( $A_n \sin(2\pi\omega_n t+]\phi_)$, where $A_n$ is the amplitude at angular frequency $\omega_n$ and phase $\phi_n$.

The processor is may also be adapted to compare peak-to-peak measurements between the first signal and the elongate receiver coil signal.

According to a further aspect of the present invention there is provided a coin apparatus comprising: a coin receiving unit including a coin validator as described above, the coin receiving unit further comprising: a coin gate positioned to divert objects input via a coin receiving inlet to an outlet; an inductor coil disposed within a throat section of the coin receiving inlet; and a coin validator input passage in communication with the coin validator; wherein in operation, when energised by the passage of an acceptable object input via the coin receiving inlet, said inductor coil provides a signal which activates the coin gate to a position in which the coin validation input passage is open to the acceptable object.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENTS

Figure 1:
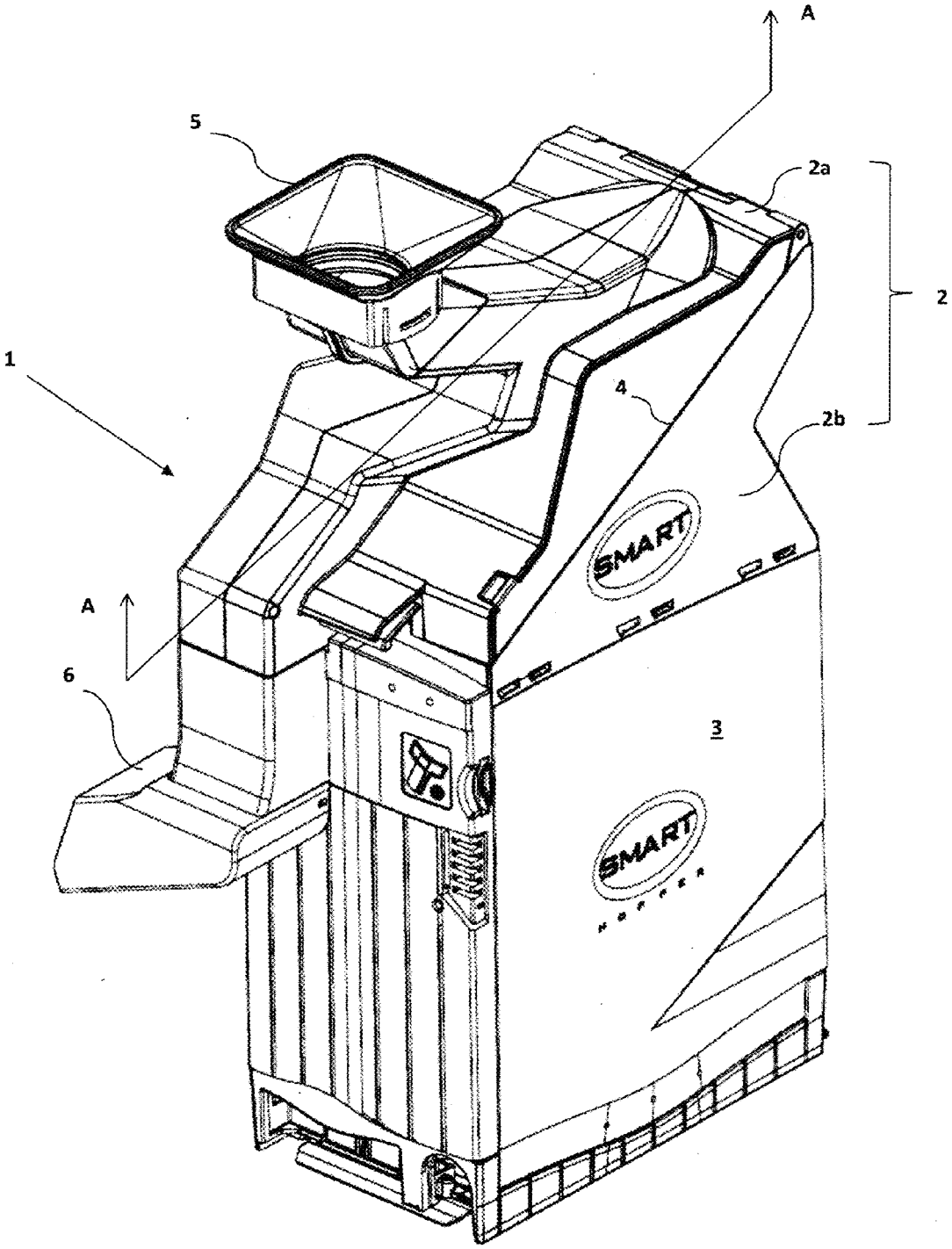
FIG. 1 shows a perspective view of a coin apparatus including a coin validator according to the present invention.

As shown in FIG. 1, a coin apparatus 1 comprises a coin receiving unit 2, coin storage and dispensing hopper 3, and a coin validator mechanism 4.

The coin receiving unit 2 comprises a cover section 2*a* pivotally attached to a lower support section 2*b*. The coin receiving unit 2 includes a coin receiving inlet 5 and a coin rejection/payout outlet 6. Coins are deposited into the coin receiving inlet 5 and channelled under gravity to the coin validator mechanism 4. The coin rejection/payout outlet 6 communicates both with a rejection outlet 11 [see FIG. 2] and a hopper outlet [not shown].

Figure 2:
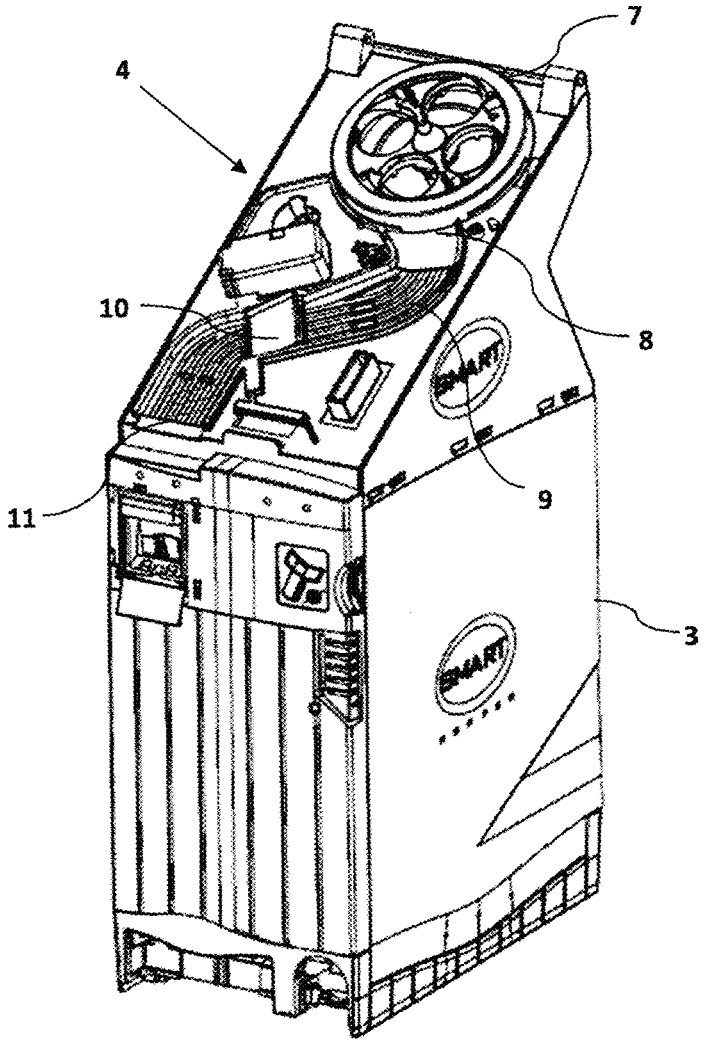
FIG. 2 shows a perspective view of the coin apparatus of FIG. 1 with the hopper removed.

The coin storage and dispensing hopper 3 is as described in WO-A-2006/079803, and the coin rotor 7 of the coin validator mechanism 4 [see FIG. 2] is constructed and functions as is also described in WO-A-2006/079803.

Figure 4:
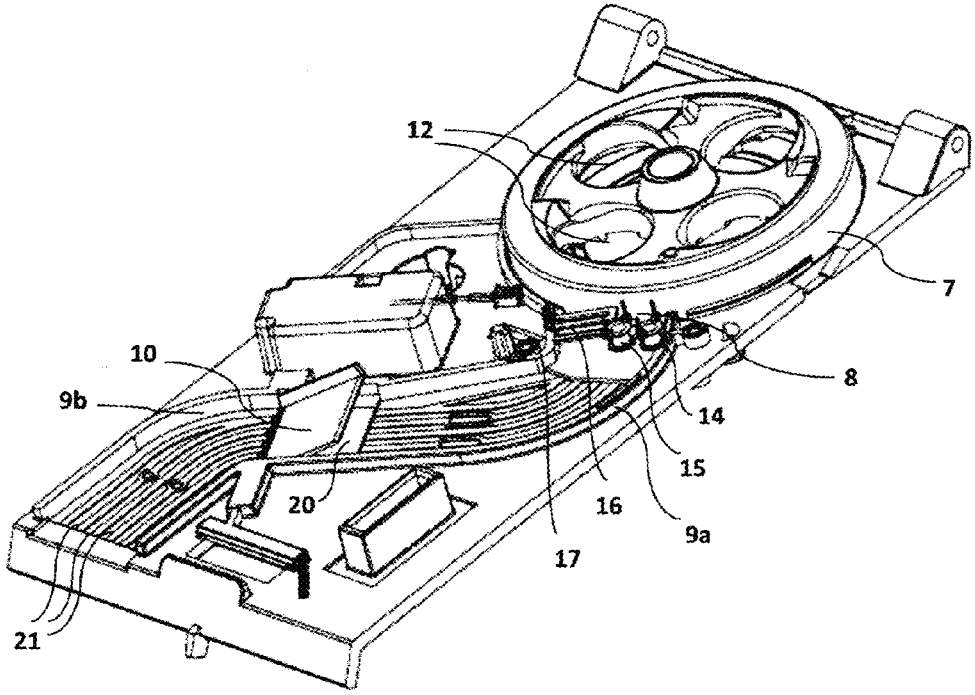
FIG. 4 shows a perspective view of the coin validator of FIG. 3.

As shown in FIG. 2, removal of the cover section 2*a* reveals the coin validator mechanism 4. The coin validator mechanism 4 comprises a coin rotor 7, a substantially S-shaped coin chute 9 that interconnects a single coin outlet 8 and a coin rejection outlet 11. The coin chute 9 includes a diverter gate 10 disposed in the floor of the chute at a position downstream from the single coin outlet 8. Further details of the single coin outlet 8 are illustrated in FIGS. 2 and 4 of WO-A-2006/079803, and are described in the accompanying text.

Figure 3:
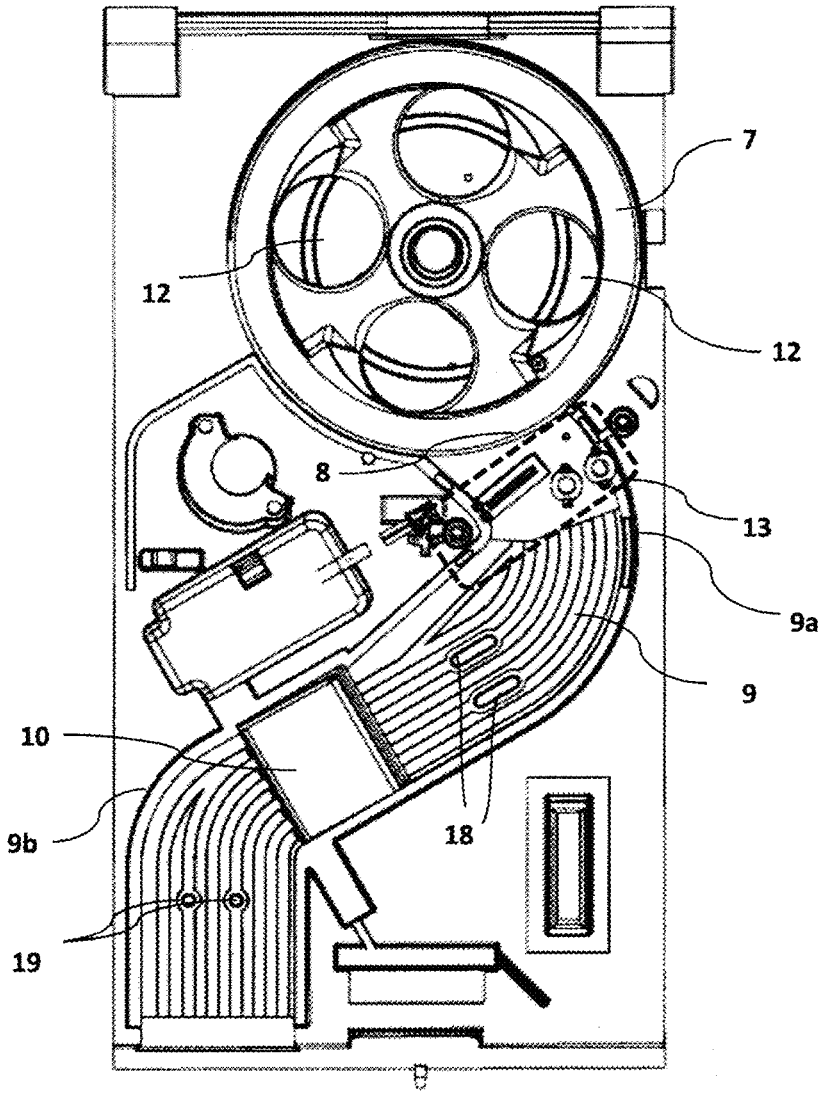
FIG. 3 shows a plan view of a preferred embodiment of the coin validator according to the present invention.

FIG. 3 shows a detailed plan view of the coin validator mechanism 4. The coin rotor 7 includes a plurality of coin receptacles 12 for receiving coins that descend from the bulk coins deposited and received in the coin receiving unit 2 via the inlet 5 [see FIG. 1]. The coin rotor 7 of FIG. 3 is shown having four coin receptacles; however it should be noted that any number of coin receptacles can be provided dependent upon the size of the coin rotor and the size and type of coins that are required to be validated.

The coin validator mechanism includes a validation sensor module 13, and this is shown in broken outline in FIG. 3. The validation sensor module 13 comprises three pairs of opposing electromagnetic coils, an acoustic sensor, and a coin percussion element proximal to the acoustic sensor [not shown] that, when struck by a coin, induces vibrational resonance in the coin.

In the Figures only the transmission coils are shown, and these are positioned above the coin chute 9. The corresponding receiver coils [not shown] are positioned diametrically opposite their respective transmission coils and beneath the coin chute 9.

FIGS. 3 and 4 show an edge transmission coil 14 positioned alongside a core transmission coil 15. The core transmission coil 15 is positioned adjacent to an elongate transmission coil 16. Also shown is an acoustic sensor 17 which is typically a microphone. It should be noted that no corresponding microphone is deployed beneath the coin chute, and that the percussion element [not shown] is suitably positioned within the path of a coin traversing the coin chute 9 such that on striking the percussion element the coin produces an audio signal that is of sufficient amplitude to be detected by the microphone whilst not positioned such that the coin is significantly diverted from a desired path.

Receiver coils [not shown] are configured to detect signals indicative of characteristics of each coin that passes through the validation sensor module 13. These characteristics include the coin size (thickness and diameter), the material composition of the coin, and whether the coin is a blank, i.e. not an authentically minted coin. Transmission coils are driven by an input signal to produce magnetic fields that couple to the receiver coils, and coins traversing the coin path pass through these field and induced eddy currents in the coin produce disturbances in the magnetic flux that is detected by the receiver coils.

Low frequency coil driving signals create magnetic fields that penetrate deeper into the body of the coin than high frequency driving signals. Consequently, high frequencies are used for surface area features and low frequencies are used for volumetric properties.

Electromagnetic sensing techniques cannot distinguish between a blank coin and one with surface markings produced in the minting process. However, an acoustic sensor (microphone) detects the resonant frequency of each coin on impact with the percussion element, and the minute frequency differences between a true coin and a blank can be detected indicating the authenticity or otherwise of each coin.

As shown in FIGS. 3 and 4, the validation sensor module includes an edge transmission coil 14 and a core transmission coil 15. In operation [see FIG. 5] when a coin 22' passes through the validation sensor module the edge of the coin passes beneath the edge transmission coil and the centre of the coin passes beneath the core transmission coil. Although not shown, it should be recognised that corresponding receiver coils are positioned directly underneath this section of the coin chute 9. In this way the validation sensor module detects a material property of the periphery of the coin in addition to simultaneously detecting a material property of the centre of the coin. This is particularly advantageous for discriminating between composite coins, such as Euro coins for example, and non-composite coins.

The validation sensor module also includes an elongate transmission coil 16 and a corresponding receiver coil for detecting the coin diameter.

In operation, the edge and core transmission coils 14, 15 are energised by a composite low frequency signal comprising a superposition of sinusoidal signal waves between 2 kHz and 50 kHz. Mathematically, this is expressed as: $\Sigma_n [A_n \sin(2\pi\omega_n t + \phi_n)]$, where $A_n$ is the amplitude at angular frequency $\omega_n$ and phase $\phi_n$. In contrast, the elongate transmission coil 16 is energised with a discrete high frequency signal lying within the range 500 kHz to 1 MHz.

Figure 7:
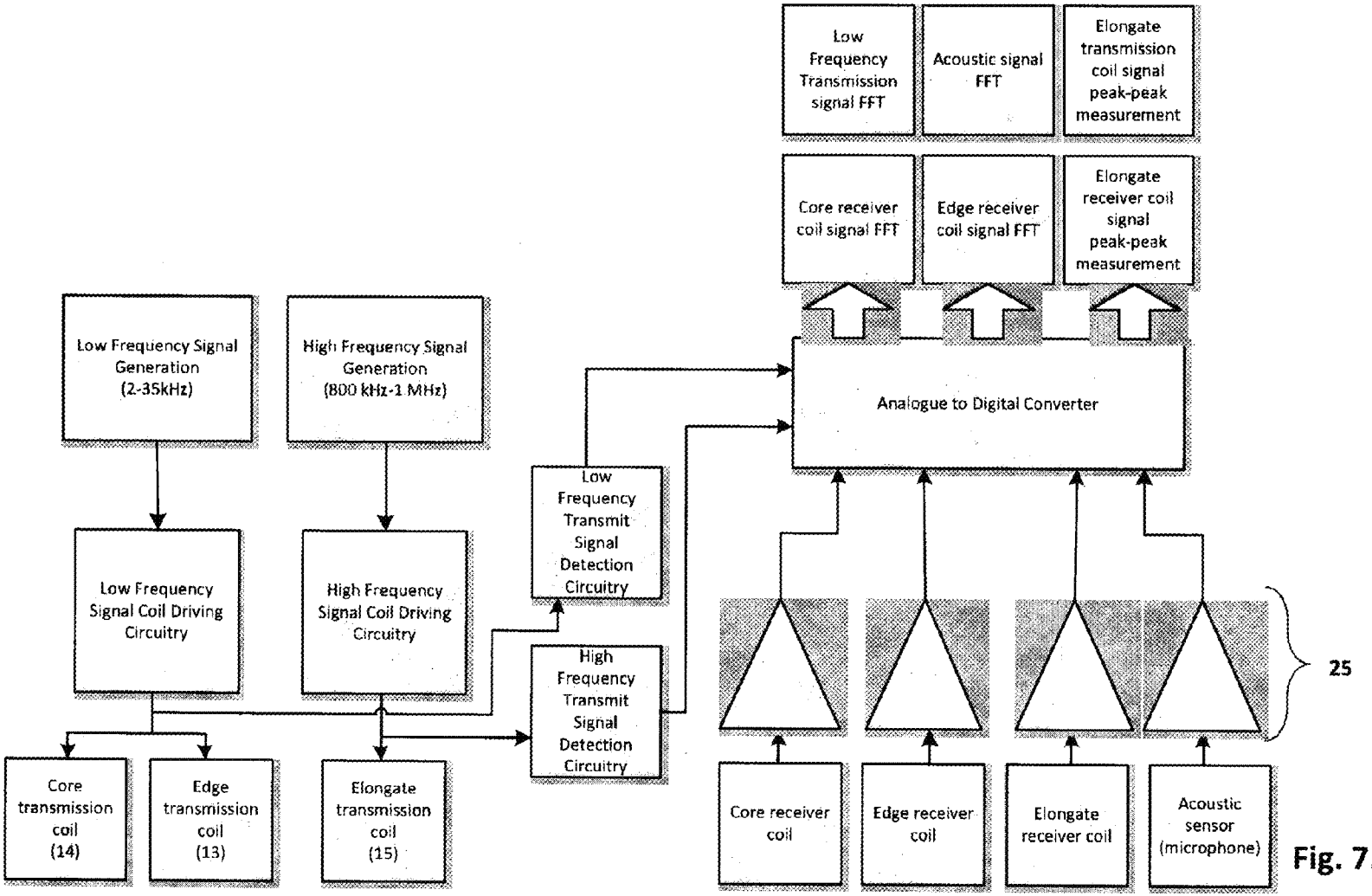
FIG. 7 is a block diagram showing the functional operation of the validation sensor module.

Referring to the functional block diagram of FIG. 7, receiver coil signals are amplified 25 and, along with the microphone signal and transmission coil signals, converted to digital signals that are processed by an on-board microprocessor to produce separate Fast Fourier Transforms (FFT) and peak-to-peak measurements from the received data. In this way signal amplitude and phase changes that result from the interposition of the coin in the electromagnetic fields can be determined from the detected wave form, along with the characteristic vibrational resonance frequency of the coin.

Figure 8:
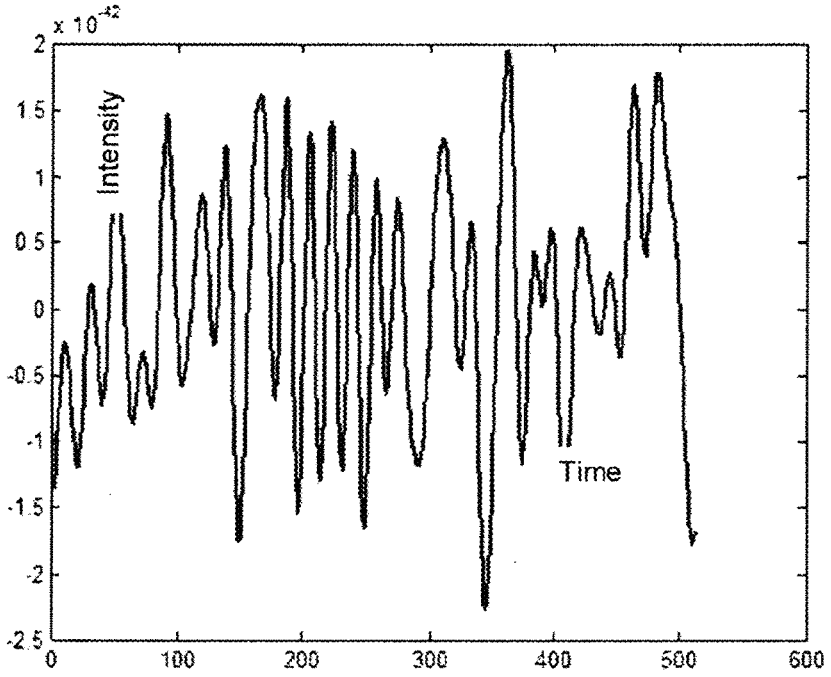
FIG. 8 shows an intensity-time graph of a core receiver coil signal.
Figure 9:
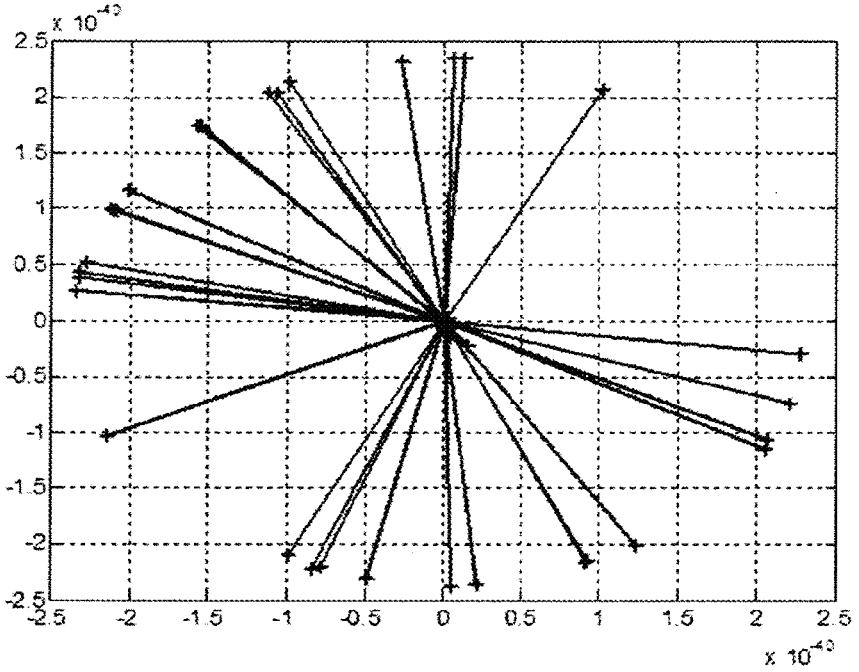
FIG. 9 illustrates an Argand diagram of a fast Fourier transform of the wave form shown in FIG. 8.

FIG. 8 shows an example of a received core coil signal and FIG. 9 shows a FFT of the resultant wave form.

As shown in FIG. 3, a coin diverter sensor comprising a pair of light guides 18 is positioned in the coin path between the validation module 13 and the diverter gate 10. Light emanating from sensor electronics [not shown] exits one of the light guides in the floor of the coin chute 9, travels in a direction orthogonal to the floor of the coin chute 9 into a light return arrangement located directly above that redirects the light back through the adjacent light guide to be received by the sensor electronics. In operation, a coin passing over the coin diverter sensor momentarily obscures the light path, and this event is detected by the sensor electronics to indicate the presence of the coin at that particular location within the coin path.

Figure 6:
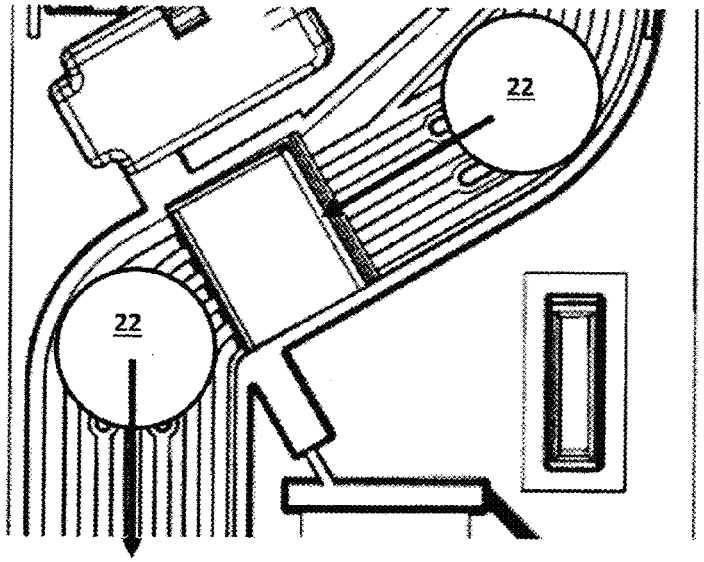
FIG. 6 shows a partial plan view of the coin validator including a schematic of the coin path downstream from that which is shown in FIG. 5.

If the coin detected at the coin diverter sensor was determined to be valid by the validation module 13, the diverter gate 10 remains open [see FIG. 4] and the coin falls under gravity into coin storage opening 20. In contrast, if the coin was determined to be invalid by the validation module 13, detection of the coin at the coin diverter sensor will trigger operation of a solenoid [not shown] to close the diverter gate 10. In the event of an invalid detection [see FIG. 6], the coin passes over the closed gate and is detected by a coin rejecter sensor comprising a further pair of light guides 19 in a similar manner to that described above in relation to the coin diverter sensor. Consequently, the sensor electronics receive a confirmatory signal that the invalid coin has exited the coin validator via the coin rejection outlet 11.

As shown in FIGS. 2 to 6, the coin chute 9 includes a plurality of ridges 21 that follow the S-shaped coin path between the validation sensor module 13 and the diverter gate 10, and between the diverter gate 10 and the coin rejection outlet 11. These ridges assist the transportation of the coin as it follows the coin path by reducing the contact between the coin and the coin chute floor, thus reducing the friction between the coin and the coin chute 9. In addition, the ridges assist in reducing the build-up of dirt and detritus within the coin chute by providing inter-ridge conduits for the outflow of unwanted debris.

Figure 5:
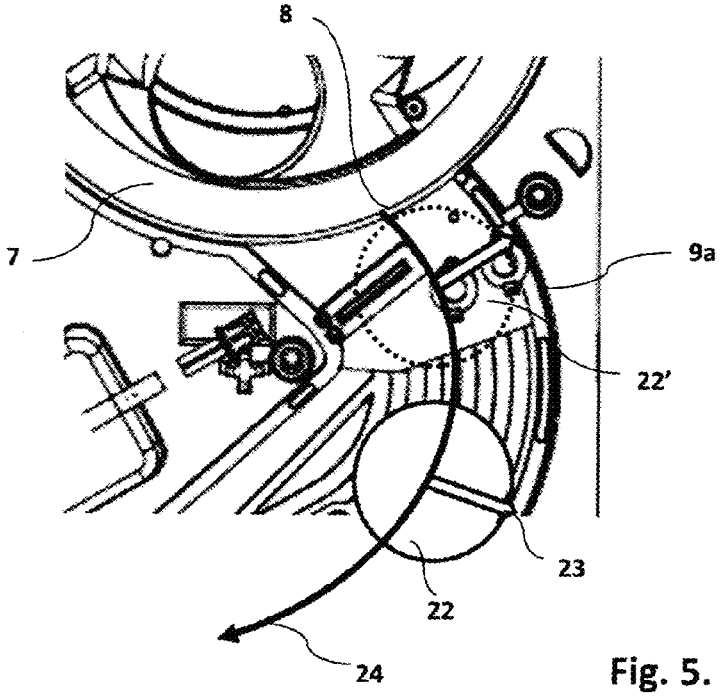
FIG. 5 shows a partial plan view of the coin validator including a schematic of the coin path.

FIG. 5 is a partial schematic plan view showing the path of a coin as it is ejected from the coin outlet gate 8 [not shown] of coin rotor 7. Initially, a coin 22' is ejected into the mouth of the coin chute. Here, the coin 22' is shown in broken line since it is travelling underneath the transmission coils 15, 16 and 17 and would be obscured by the validation sensor module. The coin enters the coin chute with the major surface of the coin in contact with the surface of the coin chute 9. That is to say that the coin does not traverse the coin path on its circumferential edge and roll in a wheel-like manner, rather it slides and rotates on its circular face.

The coin rotor 7 rotates in a clockwise direction and upon release from the outlet gate 8 centripetal acceleration urges the coin 22', 22 to follow a curved path 24 in which a circumferential edge portion 23 of the coin 22', 22 is in contact with a curved, radially outer wall **9*a*. As the coin moves towards the coin diverter sensor 18 and the diverter gate 10 it remains in contact with the outer wall even though the wall becomes straight as the coin path reaches the coin diverter sensor 18**.

Since the coin is urged to abut and follow the contour of the outer wall, the motion and speed of the coin remains stable and the coin does not laterally oscillate between the inner and outer wall of the coin chute.

If the coin ricochets between the inner and radially outer wall **9*a* it will slow down and this leads to the possibility of coin bunching and jamming in the coin chute 9*a*. Furthermore, it is desirable that the coin path and speed is stable and predictable as it travels through the validation sensor module 13** to ensure that coin sensing is consistent and substantially invariant between successive coins.

Advantageously, the problems associated with coin speed and path variability are avoided with a coin validator having a coin chute and validation sensor arrangement as described and discussed above.

Figure 10:
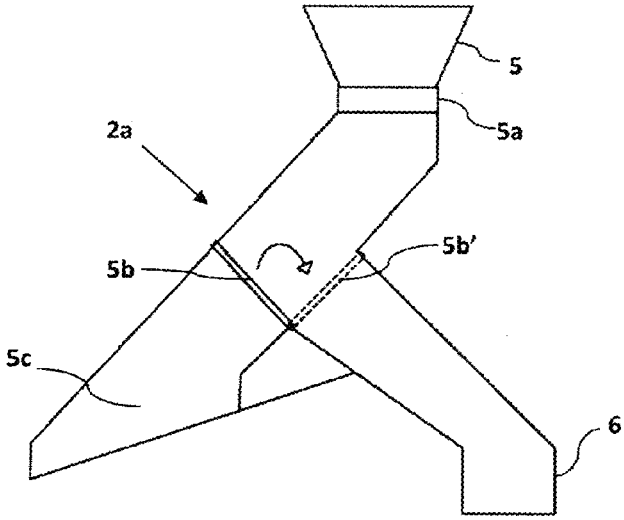
FIG. 10 shows a schematic cross-sectional view along the line A-A shown in FIG. 1.

With reference to FIGS. 1 and 10, the cover section **2*a* of the coin receiving unit 2 includes a coin receiving inlet 5 adapted to receive coins in bulk. Disposed about a throat section of the coin receiving inlet 5 is an inductive coil 5*a*** in electrical connection with a controller [not shown].

As shown in FIG. 10, the cover section **2*a* includes a coin gate 5*b* disposed between the coin receiving inlet 5 and a coin validator input passage 5*c*. The default position of the coin gate 5***b* is as shown in solid line, that is to say in a position in which entrance to the input passage 5*c* is barred. In operation, when the inductive coil 5*a* senses the input of metallic coins passing via the coin receiving inlet 5 it is energised to send a signal to the controller to divert the coin gate 5*b* to an open position 5*b*' [shown in broken line]. In this way, acceptable coins input via the coin receiving inlet 5 fall into the coin validator input passage 5*c* from where they progress to the coin validator mechanism. Also, the default position of the coin gate 5*b* diverts any object input via the inlet 5 to the rejection/payout outlet 6 when the coin receiving unit 2 is in an non-operating state or when the object is non-acceptable and does not activate the coin gate into the open position 5*b*'.

What is claimed is:

1. A coin validator comprising:

a motor-driven coin rotor mechanism including at least one coin receptacle, wherein the coin rotor mechanism is adapted to transport a coin received in said at least one coin receptacle to a coin outlet gate disposed at a peripheral edge of said coin rotor mechanism;

characterised by:

an inclined coin chute interconnecting the coin outlet gate with a coin rejection outlet via a validation sensor module and a coin diverter mechanism, the coin chute defining a coin transport path and including a radially outer curved guide wall, said coin chute arranged such that in operation a coin exiting the coin outlet gate traverses the coin transport path by sliding on a major coin face and is subjected to a centripetal acceleration that constrains the circumferential edge of the coin to follow and abut the contour of the radially outer curved guide wall downstream from the coin outlet gate in the coin transport path.

2. A coin validator as claimed in claim 1, wherein in operation a circumferential edge of the coin abuts and follows the contour of the radially outer curved guide wall between the coin outlet gate and a coin diverter sensor disposed downstream in the coin transport path, and wherein the diverter mechanism is positioned downstream from said coin diverter sensor.

3. A coin validator as claimed in claim 2, wherein the coin diverter sensor comprises a light transmitter element adjacent to a corresponding light receiver element, both the light transmitter element and the light receiver element being disposed opposite a light-return arrangement.

4. A coin validator as claimed in claim 1, wherein the coin diverter mechanism comprises an opening in the coin chute and an associated gate moveable between an open and a closed position.

5. A coin validator as claimed in claim 4, wherein the gate is biased in an open position and the opening provides coin access to a coin storage and dispensing hopper.

6. A coin validator as claimed in claim 4, wherein the opening is disposed within a floor section of the coin chute, said floor section being orthogonal to the radially outer curved guide wall.

7. A coin validator as claimed in claim 1 including a coin rejection sensor positioned downstream from said coin diverter mechanism, the coin rejection sensor comprising a light transmitter element adjacent to a corresponding light receiver element, both the light transmitter element and the light receiver element being disposed opposite a light-return arrangement.

8. A coin validator as claimed in claim 1, wherein the coin transport path defined by the coin chute between the coin diverter mechanism and the coin rejection sensor includes a radially outer curved guide wall.

9. A coin validator as claimed in claim 1, wherein the coin chute describes a substantially S-shaped coin path between the validation sensor module and the coin rejection sensor, and wherein the coin chute includes surface ridges.

10. A coin validator as claimed in claim 1, wherein the validation sensor module comprises:

an elongate transmission coil and an opposing elongate receiver coil;

a first circular transmission coil and an opposing first circular receiver coil;

a second circular transmission coil and an opposing second circular receiver coil; and an acoustic sensor disposed proximal to a coin percussion element.

11. A coin validator as claimed in claim 10, wherein the elongate transmission coil is energised by a signal at a frequency between 500 kHz and 1 MHz, the first and second circular transmission coils are energised by a signal at a frequency between 2 kHz and 50 kHz, and wherein the signal is a linear superposition of a plurality of sinusoidal waves.

12. A coin validator as claimed in claim 10, wherein the acoustic sensor is a microphone.

13. A coin validator as claimed in claim 10 including a processor adapted to receive transmission coil signals, receiver coil signals, and acoustic sensor signals, and to perform Fast Fourier Transform analysis on said signals.

14. A coin apparatus comprising:

a coin receiving unit including a coin validator as claimed in claim 1, the coin receiving unit further comprising:

a coin gate positioned to divert objects input via a coin receiving inlet to an outlet;

an inductor coil disposed within a throat section of the coin receiving inlet; and a coin validator input passage in communication with the coin validator;

wherein in operation, when energised by the passage of an acceptable object input via the coin receiving inlet, said inductor coil provides a signal which activates the coin gate to a position in which the coin validation input passage is open to the acceptable object.

15. A method of validating a coin comprising:

introducing at least one coin to a motor-driven coin rotor mechanism including at least one coin receptacle;

receiving the at least one coin in the at least one receptacle;

transporting the at least one coin via the rotor mechanism to a coin outlet gate disposed at a peripheral edge of said coin rotor mechanism;

characterised by:

providing an inclined coin chute interconnecting the coin outlet gate with a coin rejection outlet via a validation sensor module and a coin diverter mechanism, wherein the coin chute defines a coin transport path and includes a radially outer curved guide wall;

ejecting the at least one coin from the coin outlet gate such that the coin traverses the coin transport path by sliding on a major coin face while subjected to a centripetal acceleration that constrains a circumferential edge of the coin to follow and abut the contour of the radially outer curved guide wall downstream from the coin outlet gate in the coin transport path.

16. A method as claimed in claim 15, wherein a circumferential edge of the coin abuts and follows the contour of the radially outer curved guide wall between the coin outlet gate and a coin diverter sensor downstream in the coin transport path, and wherein the mechanism is positioned downstream from said coin diverter sensor.

17. A method as claimed in claim 16, wherein the coin diverter sensor comprises a light transmitter element adjacent to a corresponding light receiver element, and wherein both the light transmitter element and the light receiver element are disposed opposite a light-return arrangement.

18. A method as claimed in claim 15, wherein the coin diverter mechanism comprises an opening in the coin chute and an associated gate moveable between an open and a closed position.

19. A method as claimed in claim 18, wherein the gate is biased in an open position and the opening provides coin access to a coin collection and dispensing section, and wherein the opening is disposed within a floor section of the coin chute, said floor section being orthogonal to the radially outer curved guide wall.

20. A method as claimed in claim 15 including a coin rejection sensor positioned downstream from said coin diverter mechanism, the coin rejection sensor comprising a light transmitter element adjacent to a corresponding light receiver element, and wherein both the light transmitter element and the light receiver element are disposed opposite a light-return arrangement.

21. A method as claimed in claim 15, wherein the coin chute describes a substantially S-shaped coin path between the validation sensor module and the coin rejection sensor.

22. A method as claimed in claim 15, further comprising:

energising an elongate transmission coil with a first signal;

energising a first circular transmission coil with a second signal;

energising a second circular transmission coil with the second signal;

in response to the at least one coin passing through the validation sensor module receiving at a processor;

an elongate receiver coil signal, a first circular receiver coil signal, a second circular receiver coil signal, an acoustic sensor signal, and the second signal; and said processor performing a fast Fourier transform analysis on each of the received signals to determine amplitude and phase differences between the received signals and the second signal.

23. A method as claimed in claim 22, wherein the second signal is a linear superposition of a plurality of sinusoidal waves with frequencies between 2 kHz and 50 kHz, the first signal is at a frequency between 500 kHz and 1 MHz, and wherein the processor compares peak-to-peak measurements between the first signal and the elongate receiver coil signal.

* * * * *